United States Patent [19]

Witts et al.

[11] 4,401,994

[45] Aug. 30, 1983

[54] RECORDERS FOR RECORDING DATA

[75] Inventors: Alan G. Witts, Wimborne; Philip St. Clair Wilshire, Blandford Forum, both of England

[73] Assignee: Custom Microdesign Limited, Dorset, England

[21] Appl. No.: 341,228

[22] Filed: Jan. 21, 1982

[30] Foreign Application Priority Data

Jan. 22, 1981 [GB] United Kingdom ..... 8101944

[51] Int. Cl.[3] ..... G07C 1/06

[52] U.S. Cl. ..... 346/83; 235/377; 346/134; 360/2

[58] Field of Search ..... 346/82, 83, 95, 104, 346/134; 360/2; 235/377, 419

[56] References Cited

U.S. PATENT DOCUMENTS

| | | | |
|---|---|---|---|
| 3,942,182 | 3/1976 | Sato | 346/82 X |
| 4,011,434 | 3/1977 | Hockler | 235/377 |
| 4,017,857 | 4/1977 | Evans | 346/82 X |
| 4,170,015 | 10/1979 | Elliano | 346/82 X |
| 4,270,043 | 5/1981 | Baxter | 235/377 X |
| 4,333,085 | 6/1982 | Witts | 346/83 X |

*Primary Examiner*—Joseph W. Hartary

*Attorney, Agent, or Firm*—Shoemaker and Mattare, Ltd.

[57] ABSTRACT

A time cost recorder enables entry and exit transactions to be recorded at will both by a badge bearing digitally encoded machine readable identity information and by a card bearing both digitally encoded machine readable identity information in the same recording medium and form as a badge and visible characters referring to the entry and exit transactions. Constant instructions for operation of the machine are stored in read-only memory, and a random-access memory includes locations severally allocatable to the badges and cards for recording the data relating to the entry and exit transactions of each badge or card according to the identity thereof. Thus badges are passed in the direction of arrow 4 through a combined reader and printer and cards are inserted in the direction of arrow 6 into a combined badge reader/printer that has a motor driven card transport roller that moves the card into and then out of the reader/printer. If the badges and cards carry the encoded information recorded on a magnetic stripe then correct insertion thereof may be tested for by attenuation of a reflected infra-red signal at the stripe.

27 Claims, 12 Drawing Figures

LEGENDS
PC = prep. cards
PT = print totals
AT = adjust totals
R = reset
PP = print program
TS = time set
P = program

NAME. E. SMITH NO. 12567653 4S
DEPT 2769 PERIOD END 23/80

| DT | IN | OUT | IN | OUT | TOT | ACC |
|---|---|---|---|---|---|---|
| 01 | 07:30 | 12:35 | 13:55 | 17:23 | 9:32 | 9:32 |
| 02 | 07:23 | 12:31 | 13:48A | 18:56 | 10:23 | 19:55 |
| 03L | 09:12 | 12:33 | 12:59E | 16:12 | 5:26 | 25:21 |
| 04 | 07:37 | 12:51 | 13:21 | 17:23 | 9:23 | 34:44 |
| 04M | 18:06 | 19:03 | | | 10:20 | 35:41 |
| 05 | 07:55E | 12:01 | | | 4:06 | 39:47 |
| 06 | 07:21 | 12:49 | 13:23G | 15:12 | 7:12 | 46:59 |
| 06 | 16:21 | 18:49 | | | 9:41 | 49:20 |
| 08 | 07:30 | 12:35 | 13:55 | 17:23 | 9:32 | 9:32 |
| 09 | 07:23 | 12:31 | 13:48A | 18:56 | 10:23 | 19:55 |
| 10L | 09:12 | 12:33 | 12:59E | 16:12 | 5:26 | 25:21 |
| 11 | 07:37 | 12:51 | 13:21 | 17:23 | 9:23 | 34:44 |
| 12M | 18:06 | 19:03 | | | 10:20 | 35:41 |
| 13 | 07:55E | 12:01 | | | 4:06 | 39:47 |
| 14 | 07:21 | 12:49 | 13:23G | 15:12 | 7:12 | 46:59 |
| 15 | 16:21 | 18:49 | | | 9:41 | 49:20 |

11

| PER | TOTS | RATE | TOTALS |
|---|---|---|---|
| REG | 38:00 | 10.00 | 380.00 |
| OTA | 4:00 | 15.00 | 60.00 |
| OTB | 2:00 | 20.00 | 40.00 |
| OTC | 5:20 | 30.00 | 150.60 |
| GROSS PAY FOR PERIOD | | | 530.60 |

FIG. 3

RECORDERS FOR RECORDING DATA

FIELD OF THE INVENTION

This invention relates to recorders for recording data on cards and can very conveniently be applied to time recorders for employees clocking in and out of work in an industrial establishment.

BACKGROUND TO THE INVENTION

Until recently, time recorders have been mechanical devices requiring regular maintenance to ensure reliable operation and they are very limited in the facilities they can offer in addition to the simple recording of in/out times. Recently, electronic time recorders have become available, see for example U.S. Pat. No. 4,270,043 (Kronos) that employs an optically readable card and U.S. Pat. No. 4,017,857 (Evans et al) that suggests a time accounting system based on cards bearing a magnetic stripe. Currently there are two fundamentally different types of equipment used for employee time recording. Time card recorders use cards of paper or the like material that may carry employee identifying information and are required to carry printed information relating to the several entry and exit transactions that the card is used to perform in a form that is legible to the employee. Then there are badge-based recorders in which magnetic or punched hole badges bearing identity information are inserted into the recorder at each entry or exit transaction but no employee legible characters are printed thereon, all pertinent information being held in the internal memory of the recorder. But it is impractical to use badges for all groups of employees because of the desire of many employees to have a permanent written record such as a time card.

SUMMARY OF THE INVENTION

It is one object of the invention to provide a time recorder in which cards and badges may be given at will to employees and both cards and badges can be used to make entry and exit transactions.

In one aspect the present invention provides, in combination with badges each adapted for recording thereon of digitally encoded machine readable identity information and cards adapted both for recording digitally encoded machine readable identity information and printed information in visible characters, a time/cost recorder for use in recording entry and exit transactions comprising a badge reader for reading the digitally encoded data on a badge inserted therein;

a combined card reader/printer including means defining a path for card insertion and discharge, a reader for reading the digitally encoded information on a card inserted therein and a printer assembly for printed visible characters on an inserted card recording the entry or exit transaction; and a digital data processing and control system fed with information from the badge reader and the card reader/printer and arranged so that an entry or exit transaction may be recorded using either a badge or a card.

In a more specific aspect the invention provides a time/cost recorder for use in recording entry and exit transactions by badges bearing digitally encoded machine readable identity information and by cards bearing both digitally encoded machine readable identity information in the same recording medium and format and printed information in visible characters referring to the entry and exit transactions comprising:

read-only memory means for storing constant instructions for operation of the recorder;

random-access memory means including locations severally allocatable to the badges and cards for recording data relating to the entry and exit transactions of each badge and/or card according to the identity thereof;

a badge reader for reading the digitally encoded data on a badge inserted therein;

a combined card reader/printer including means defining a path for card insertion and discharge, card transport means including a drive motor for advancing an inserted card into the reader and ejecting it therefrom, a reader for reading the digitally encoded information on a card inserted therein and a printer assembly for printing visible characters on the inserted card;

a clock for supplying time signals; and a digital data processing and control system that receives the time signals and is arranged on receipt of a badge by the badge reader to update the memory locations referring to that badge in accordance with the indicated time and on receipt of a card by the reader/printer to cause the transport means to convey the card into the reader/printer so that the recorded information is read by the reader the memory locations referring to that card are updated in acordance with the indicated time, visible characters are printed on the card recording the transaction and the processed card is ejected from the reader printer whereby an identity may be allocated interchangeably to a card or to a badge either of which may be used to record an entry or exit transaction.

In a third respect the invention provides a time/cost recorder for use in recording entry and exit transactions by badges bearing digitally encoded machine readable identity information and by cards bearing both digitally encoded machine readable identity information and printed information in visible characters referring to the entry and exit transactions, comprising a badge reader for reading the digitally encoded data on a badge inserted therein;

a combined card reader/printer including means defining a path for card insertion and discharge, card transport means including a drive motor for advancing an inserted card into the reader and ejecting it therefrom, a reader for reading the digitally encoded information on a card inserted therein, a printer assembly for printing visible characters on the inserted card and a writing head for writing onto the card encoded identity information; and a badge holder having the external dimensions of a card and having means for holding a badge in such position that when the badge holder is inserted into the reader/printer it traverses the writing head so that identity information is written in the appropriate position thereon.

DESCRIPTION OF THE PREFERRED EMBODIMENT

The invention is particularly suited for use with badges and cards that each carry a stripe of magnetic material for recording the digitally encoded information, in which case the badge reader and the card reader/printer are each provided with a magnetic reading head for reading the encoded information on the stripe. The digital data processing and control system may then include a decoder that decodes both the information read from the badges by the badge reader and the information read from the cards by the card reader.

The random-access memory means further includes locations for storing user-variable instructions for operation of the recorder. Such instructions may relate to shift patterns, hours of work within each shift pattern and rates of pay or cost accumulation within each shift pattern. The random-access memory location allocated to each badge or card identity may include a first accumulator in which is recorded time worked in each day or other shift cycle, a second accumulator in which is recorded time worked in an accounting period defined by an integral number of days or other shift cycles terminating with the present day or cycle, and at least third and fourth accumulators in which time worked is stored at different rates according to user-variable rates of pay or cost accumulation.

A particularly advantageous feature of the invention is the arrangement of the badge reader that is provided with a sensor that indicates the presence of a correctly inserted badge. Such a sensor may take the form of an infra-red light emitter and a closely spaced infra-red photoconductor located in the track that the magnetic stripe on a badge is to take through the reader on the same side as the reading head and in advance thereof with respect to the intended badge travel direction, and an infra-red reflector is located opposite the sensor that when no card is present reflects radiation from the emitter to the photoconductor, the attenuated reflection from the magnetic stripe of a correctly inserted badge interposed between the emitter and the reflector resulting in a reduced current in the photoconductor that is perceived by the data processing and control system as a card correctly present signal.

Conveniently the printer assembly is arranged to print on one side of the card and the magnetic stripe is located on the other side of the card. The badge reader and the combined card reader/printer may be so arranged that the direction of travel of the badges through the badge reader is perpendicular to the direction in which cards are conveyed into and from the card reader, this arrangement minimizing mistakes by employees.

The digital data processing and control system controls the printer so that it prints on each card the employee name and number and lines of print across the card each of which includes a day's date, in/out times for the day, the total working time for the day and the accumulated working time for a period terminating with the day. Also printed on the card may be gross earnings accumulated over the working period calculated according to a normal time rate and to one or more overtime rates and the total of the employee earnings for that time period.

The card reader/printer will normally further comprise a magnetic writing head controlled by the digital data processing and control system that can be used to write onto the stripe of magnetic material on the card the identity data and during an entry or an exit transaction the updated information recorded in the random-access memory locations allocated to the card.

If a badge is temporarily held in a holder having the dimensions of a card that includes means to temporarily support the badge in the correct track alignment and that holder is inserted into the card reader, identity information may be written onto a badge. This will in fact be the normal method of doing so and it is an advantage that flows from the common data format for the badges and the cards that no separate badge encoder is necessary. The badge writing function using the badge holder secured into the card reader/printer is a special function that may be enabled by passage of another specially coded badge through the badge reader.

In operation the data processing and control system is arranged to cause the card transport means to be driven forwardly by the motor to advance the card into the reader/printer and during the card advance to cause the reading head to read the encoded information on the stripe of magnetic material, subsequently to cause the writing head to write the updated information thereon, after which the card transport means is driven in reverse to convey the card to the position where the visible characters recording the transaction are to be printed, stopped during printer operation and driven again in reverse to eject the card from the reader/printer. A first sensor located adjacent the entrance of the reader/printer detects the insertion of a card therein and signals the data processing and control system to start the card transport means advancing the card into the reader/printer. Beyond the first sensor there are provided second and third sensors each comprising an infra-red emitter and an infra-red photoconductor one of them being located in the track of the magnetic stripe on the card and having an opposed infra-red reflective surface, the other not, whereby conveyance of a correctly positioned card past the second and third sensors causes the signals from the normally high detector to fall by attenuation of the infra-red radiation at the stripe of magentic material and causes the signal from the normally low detector to go high by reflection from other regions of the card, simultaneous reception of both these signals by the data processing and control system indicating the presence of a card correctly positioned in the reader/printer after which the drive motor is enabled. A fourth sensor is located beyond said second and third sensors, passage of the card beyond the fourth sensor causing the writing head to be enabled. Thus once it has received the signal from the second and third sensors denoting the presence of a correctly inserted card the data processing and control system is arranged to cause the card transport means to continue advance of the card into the reader/printer until the attenuated infra-red reflection signal of the stripe of magenetic material is no longer received, after which the card transport means is driven in reverse at a slow speed until the attenuated infra-red reflective signal is again received thereby defining the position of the top edge of the card and the card transport means is again driven in reverse to the position where visible characters are to be printed. This use of the infra-red reflection attenuating properties of a track of magnetic material is believed to be novel.

BRIEF DESCRIPTION OF THE DRAWINGS

An embodiment of the invention will now be described by way of example only with reference to the accompanying drawings in which:

FIG. 3 is a front elevation of a record card as used in association with the recorder of FIGS. 1 and 2 and FIG. 3*a* is a rear elevation of a badge holder;

DESCRIPTION OF THE PREFERRED EMBODIMENT

General structure and operation of the time recorder

Figure 1:
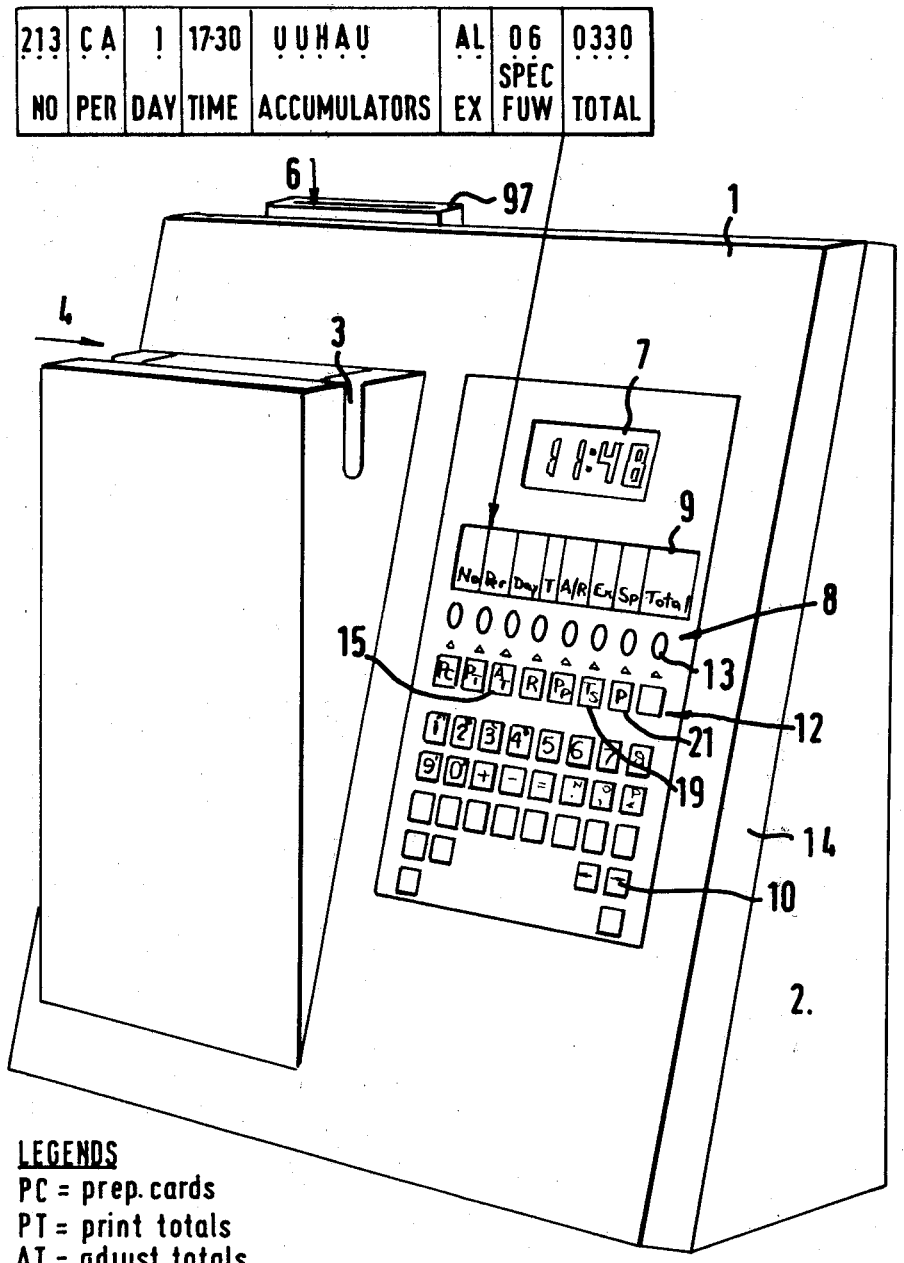
FIGS. 1 and 2 are respectively a front perspective view and a side elevation of a time recorder.
Figure 2:
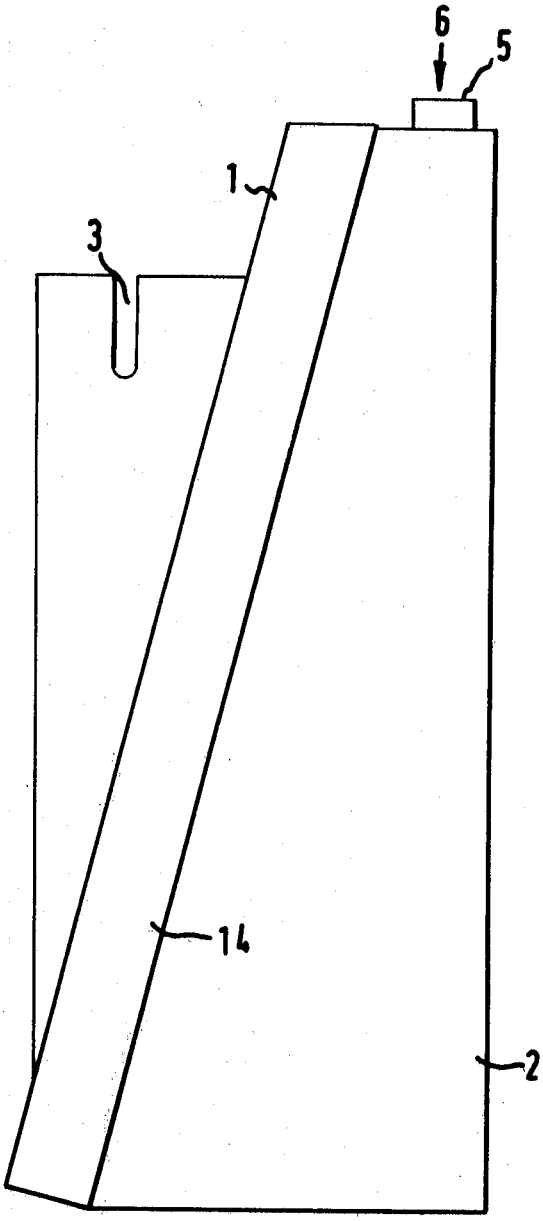

Referring to FIGS. 1 and 2, the time recorder is housed in a case which may either be located on a desk top or wall mounted and comprises a vacuum formed zinc alloy cover 1 and a fabricated sheet steel chassis 2 on which various electronic and mechanical components are located. For wall mounting, a folded steel wall plate is screwed onto the wall so that unskilled personnel can mount the case on the plate without access to the inside of the case being necessary.

The case presents a magnetic badge reader 3 through which badges in a vertical plane may be passed in the direction of arrow 4. Such badges enable some or all employees in an industrial establishment to clock in or out using badges instead of time cards, if required. Such badges can be centrally encoded with an employee's number and shift, using a separate encoder or they can be encoded on the present machine using a badge holder card as described above. The badge reader 3 can also receive magnetic security badges as described below.

Figure 3A:
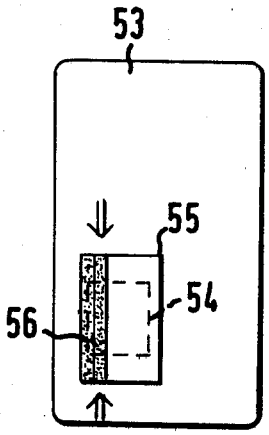

The cover 1 is formed at the top with a slot leading to a combined card reader/printer into which cards (FIG. 3), when in a vertical plane, can be individually inserted in the direction of the arrow 6 to receive printed information from a dot matrix print mechanism. Such mechanism is well known in the trade and can print up to forty characters across the card. Insertion of the card causes a motor driven device to feed the card substantially completely into the case before printing takes place, thereby preventing the user from tampering with the card during this process. After printing the card is raised to a position where it can be manually withdrawn through the slot.

A liquid crystal time display 7 and keyboard/program display assembly 8 are presented on a part 14 of the cover 1 which is sloped for user convenience.

Each card is printed on one or both faces and individual data allocated to the employee is recorded in magnetic stripe or stripes 11 (FIG. 3) on the back of the card. This enables a microcomputer (FIG. 11) and peripheral units to control the print mechanism for printing on the card such information as is appropriate to the employee and also to write the information magnetically onto the stripe(s). For this purpose the main program facilities provide five accumulators for each employee, namely an accumulator d which is reset at the end of each standard day, an accumulator p which is reset at the end of a specific period and accumulators A, B, C respectively used to store time worked at three different rates according to overtime rules programmed into the machine. The daily and period totals are printed at pre-programmed times in the way shown in the upper part of the card in FIG. 3 where for each of a series of days, the data, in and out times, total time for the day and time accumulated since the beginning of a period are printed across the card.

The totals in accumulators A, B, C are printed at pre-programmed times (normally at the end of each period) as shown at the bottom of the card in FIG. 3 where the totals derived from printed times respectively at the regular rate and rates A, B, C are added to record the gross pay for the period.

Referring now to the keyboard/program display assembly 8 this includes near its top a row of eight display panels 12 each having an associated light emitting diode 13 that is illuminated when the function or event annotated on the panel requires attention. Above the display panels 12 is a horizontal 24 character 7-segment alphanumeric display 9 arranged to be selectively illuminated. For example, in a program mode (panel 21) the entire display is illuminated whereas only parts of the displayed legend are illuminated in an "accumulated totals adjust" mode (panel 15) or in a "time set" mode (panel 19).

Now considering the program structure in greater detail, the program is divided into shifts (each comprising, for example, thirty employees) and then into program lines (each allocated to an employee) within the shift. Each program line comprises up to twenty-four alphanumeric characters to be displayed in the display 9. A typical line is shown in FIG. 1. The codes according to which the twenty-six characters are used will now be described.

The symbol "No." at the left-hand end of the display 9 indicates three digits identifying a shift and line number within the shift. Thus, in the example 213 identifies shift 2, line number 13.

The symbol "PER" indicates two characters that specify the type of period and particular week(s) within the period to which the time line applies. An example of the type of code used is as follows:

| | |
|---|---|
| A = Weekly | A = All weeks in period |
| F = Fortnightly | 1 = Week 1 in period |
| b = bi-Monthly | 2 = Week 2 in period |
| C = Calendar Monthly | 3 = Week 3 in period |
| 4 = Week 4 in period | |

Therefore, in the example of FIG. 1, CA means weekly payments for all weeks in the period. Alternatively, if the first "PER" character is 0 or 1, it means the two character group is being used to specify a calendar month, for time control or time set purposes, eg. 01 for January, 02 for February, etc.

The symbol "Day" in the display 9 indicates a day within a given period. If the period is weekly or fortnightly (codes A or F in the left-hand column above), 1=Monday, 2=Tuesday etc. and A=All Days, B=Mon.-Thurs., C=Mon.-Fri. Thus, in FIG. 3, Monday is indicated. If the period is bi-monthly or monthly (codes b and C), the characters selected from 01 to 31 indicate the day of the month.

The symbol "TIME" in the display 9 indicates the time to which the shift line applies. In the example the period is 17 hours, 30 minutes.

The symbol "ACCUMULATORS" in the display 9 relates to the five accumulators d, p, A, B, C, already discussed, allocated to each employee. In the code, U=unchange, H=halt and A=activate. Thus in the example in FIG. 1, UUHAU means that accumulators d, p, c are unchanged, accumulator A is halted and accumulator C is activated.

The symbol "EX" in the display 9 indicates exceptions pertaining to an allowance period. A is printed on the card if clocked in during an allowance period and L is printed on the card if clocked in after an allowance period.

The symbol "SPEC FUN" is used for specifying a special function that applies to the particular line number, eg. 06 specifies the end of normal working day. Then the final symbol "TOTAL" is used to specify a time period associated wth the special function, eg. as shown in FIG. 1, 03.30 associated with 06 means that overtime is enabled for three and a half hours after the end of the working day.

Ten supervisor functions can be selectively enabled by feeding appropriate magnetic security badges through the badge reader 3. One such function is to prevent an employee from clocking in or out without a supervisor enabling the operation with his badge, this being indicated by the illumination of display 9 to show a legend such as "in enabled" or "out enabled". The number of the supervisor's badge is then printed automatically on the employee's card.

A second supervisor function is to enable a blank card, when inserted into the recorder, to be initialised by printing an employee's number automatically thereon when the number has been set by means of selected keys on the keyboard 10. Display of a suitable legend on display 9 indicates that the recorder has been enabled for this. Once a card has been initialised, the preset number is incremented automatically in the microcomputer, enabling a batch of cards to be quickly initialised, assuming the 30 time recorder is retained in the "prepare cards" mode.

A third supervisor function is to encode an identity or other information onto a badge. For this purpose, a badge holder 53 (FIG. 3*a*) having the external dimensions of a card has an appropriately positioned adhesive window 54 or other means for temporarily holding the badge in position. A badge 55 is adhered to the window with its magnetic stripe 56 in alignment with registration marks and in the appropriate longitudinal and transverse position on the card for encoding the necessary 10 information thereon. When the badge holder is inserted into the card reader/printer (described below) the stripe 56 is in correct alignment for traversing a magnetic read head and a magnetic write head therein. Again when an employee badge is being encoded a suitable legend is 15 illuminated on display 9 and an employee number is allocated to the badge.

A fourth supervisor function is to enable the print out of the accumulator totals on an employee's card. This results in the display 9 being appropriately illuminated 20 and is followed by pressing a key allocated to this function (it being understood that certain of the keys on keyboard 10 serve as function keys and as digital or alphabetical keys) followed by keys specifying a start number determining the block of thirty employees that 25 includes the employee in question.

A fifth supervisor function is to enable the print out of a user-variable program, ie. the legend in the display 9. This results in the display of a suitable legend in display 9 and is followed by the depression of appropriate 30 function and start number keys.

A sixth supervisor function is to enable the adjustment of the day (d) accumulator. When the appropriate function key is pressed, the "TOTAL" field in display 9 is illuminated and shows 00.00. Using the keyboard, this 5 value can be adjusted (+ or −). All cards subsequently entered have their d accumulators adjusted by the newly set amount until another mode is selected, or the adjustment value cleared to 00.00.

A seventh supervisor function is similar to the fifth except that it is applied to the period p accumulators.

An eighth supervisor function enables the accumulated totals of all employees in a selected shift to be reset. Keys representing the selected shift (or start) number are depressed to return the totals to zero.

A ninth supervisor function enables a "time set" function. The display 9 is illuminated as are the values of NO., PER, DAY, TIME in the display. These values can then be modified by pressing appropriate keys.

A tenth supervisor function causes the illumination of the entire display 9. The legend in the display 9 can then be modified by pressing the appropriate keys.

Figure 4:
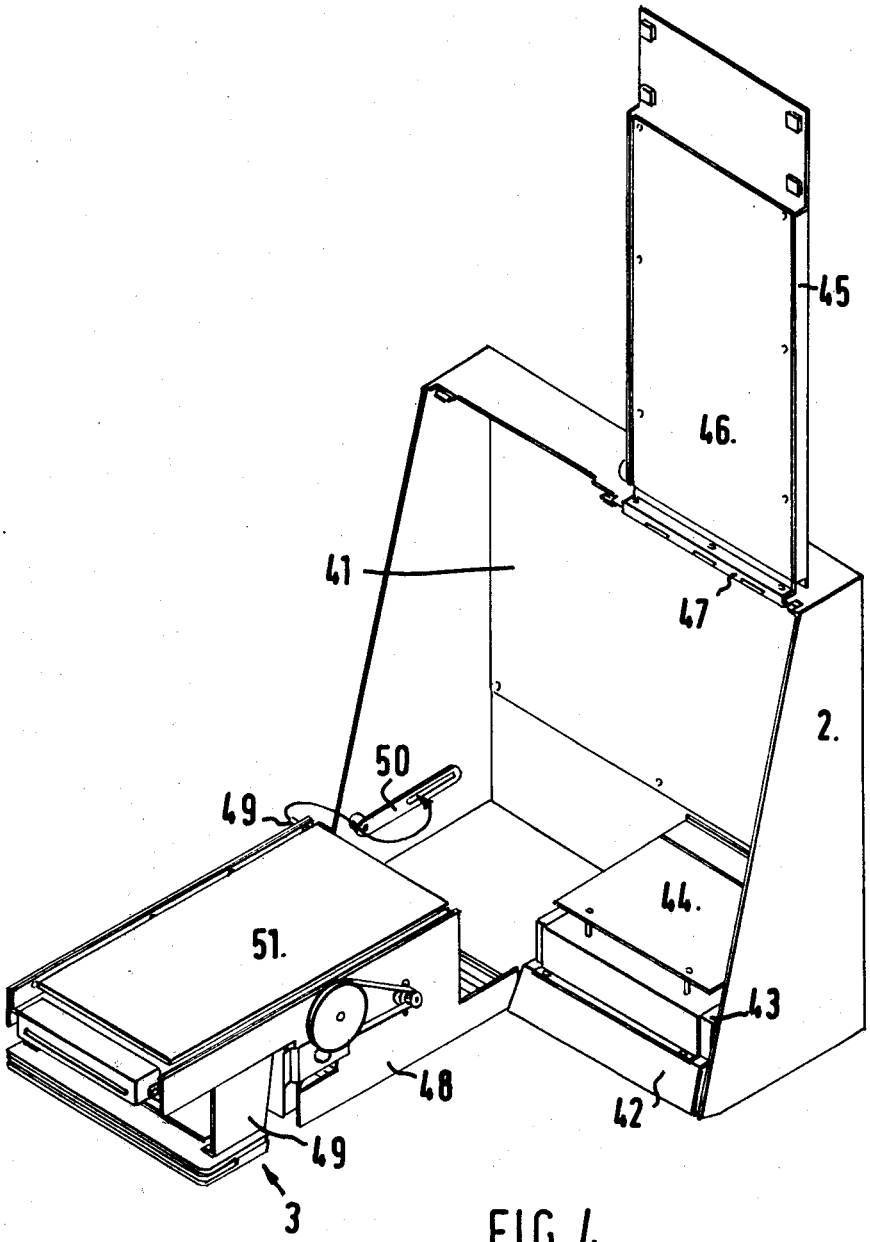
FIG. 4 is a perspective view of the time recorder with its front cover removed to reveal a card reader/printer assembly which is in its lowered position and a keyboard display/support panel which has been raised to reveal the master electronics printed circuit board and its associated power supply units.

FIG. 4 shows the chassis 7 with the front cover removed to reveal a master printed circuit board 41 that carries inter alia the microcomputer, read-only and random-access memory chips, peripheral input/output devices and a CMOS clock. At the lower right-hand corner is an input/output module 42 for remote communication links that enable the time recorder to communciate directly or through telephone lines to a central computer installation for large network applications. A battery 43 supplies power to maintain the working of the recorder in the absence of external power supply and contains sufficient stored power to enable 500 entry or exit clockings to be made. A power supply board 44 is located above the battery 43.

The keyboard/program display 8 is supported on a support panel 45 having an associated printed circuit board 46 and hinged to the chassis 2 at a hinge strip 47. Also hinged to the chassis 2 so that it may be pivoted forward as shown in FIG. 4 is the card reader/printer assembly 48 that is mechanically stabilised by peg 49 that locates in a support strap 50. As will be seen the badge reader 3 is carried on the card reader/printer assembly 48 by means of brackets 49. Also apparent is the sensor printed circuit board 51.

The Badge Reader

Figure 5:
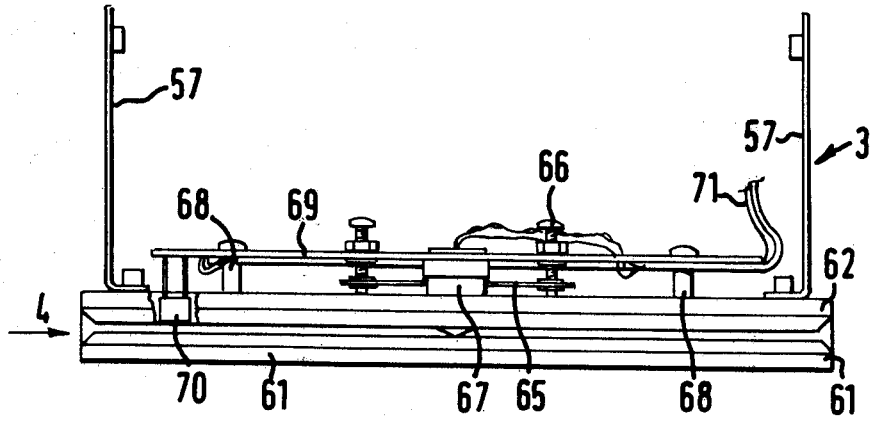
FIGS. 5, 6 and 7 are respectively a plan, front elevation and side elevation of a badge reader assembly that is attached to the card reader assembly of FIG. 4.
Figure 6:
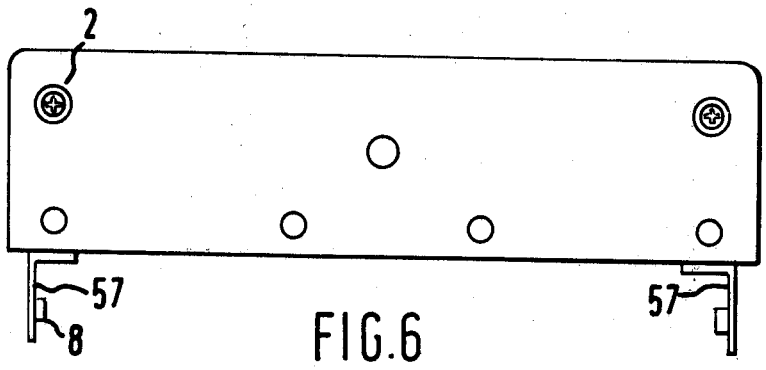
Figure 7:
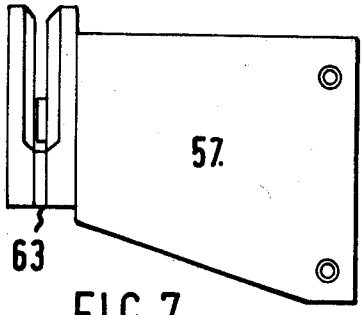

In FIGS. 5, 6 and 7 there is shown a reader for a badge that is provided with a magnetic stripe of metal oxide material on which digital information is recorded and conforming eg. to 3554-1976 Standard.

The badge fits into a generally U-shaped channel defined by a front faceplate 61, a rear faceplate 62 and sandwiched between them an edge guide 63. Left-hand and right-hand mounting brackets 57 are secured to the rear faceplate 62. A magnetic read head 67 mounted on a spring 65 protrudes through rear faceplate 62 into the channel in such a position as to traverse the magnetic stripe of a badge moved along in the channel in the direction of arrow 4. The spring 65 is fixed by adjustable screws 66 to a printed circuit board 69 mounted to rear faceplate 62 on spacers 68. The board 69 also carries at the inlet end of the channel with respect to the intended direction of movement of the badges therealong a reflective infra-red detector 70 designation No. OPB-706B (Norbrain) that also registers with the magnetic track of a badge conveyed along the channel and protrudes through an aperture in the rear faceplate 62. The detector comprises an infra-red emitter and an adjacent infra-red light sensitive device. Opposite the detector is provided an infra-red reflector of aluminium or other reflective material in front faceplate 1.

So as a badge is introduced into the channel with its track correctly positioned, that track is first sensed by sensor 70. In its normal state the sensor detects infra-red radiation reflected from the emitter by the aluminium reflector and gives a high output. But as the badge is introduced the reflected infra-red radiation is attenuated at the magnetic track and output from the detector goes low. This low output may be used to tell the associated digital processing system to await data read in through read head 67. But if the badge is inserted the wrong way round or the wrong way up, or if simply a sheet of paper is inserted into the badge reader, the reflected infra-red at sensor 70 remains high and does not give a response. Leads 71 from the sensor 70 and from the read head 67 are connected to the card sensor printed circuit board 51 (FIG. 4).

The card reader/printer

Figure 8:
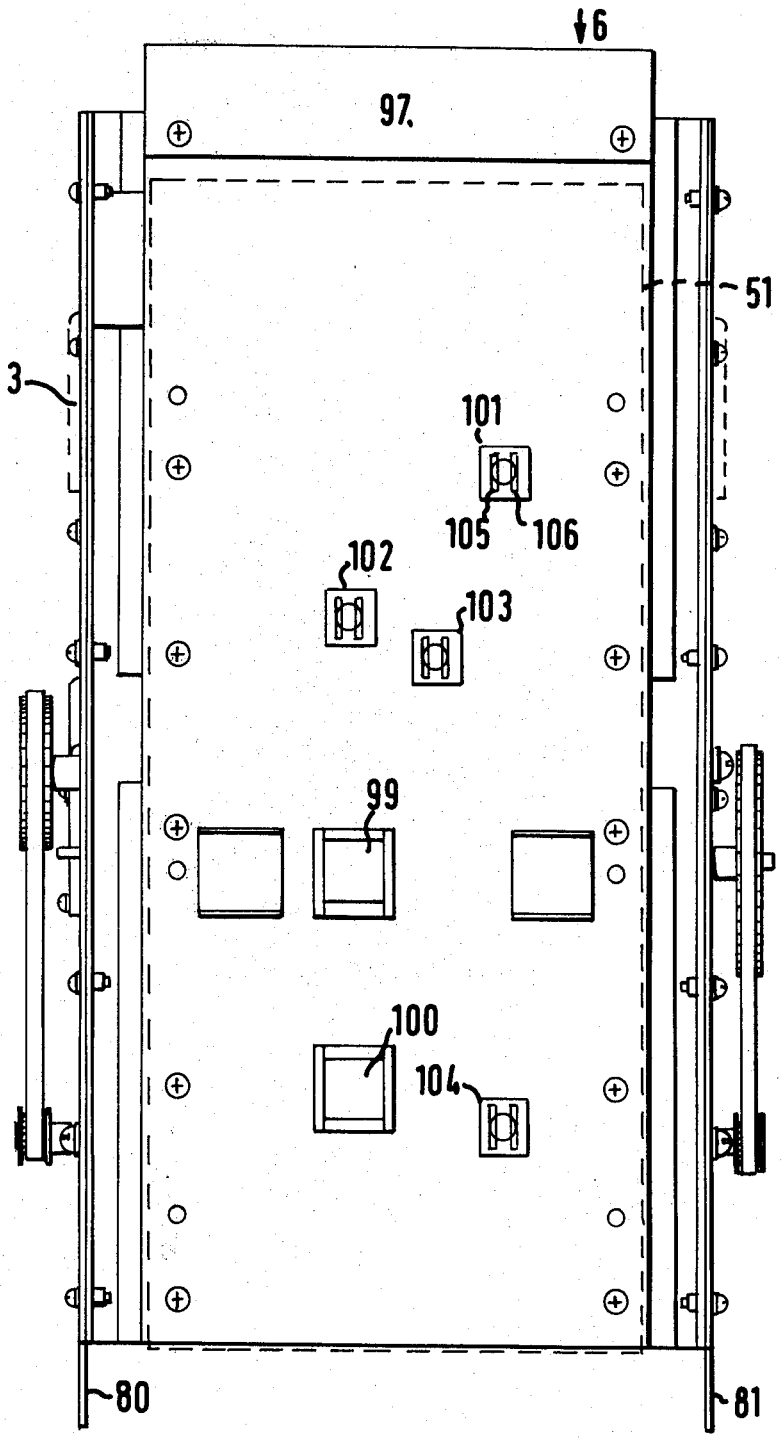
FIGS. 8, 9 and 10 are respectively a plan front elevation and underneath plan of the printer mechanical assembly with the badge reader in position.
Figure 9:
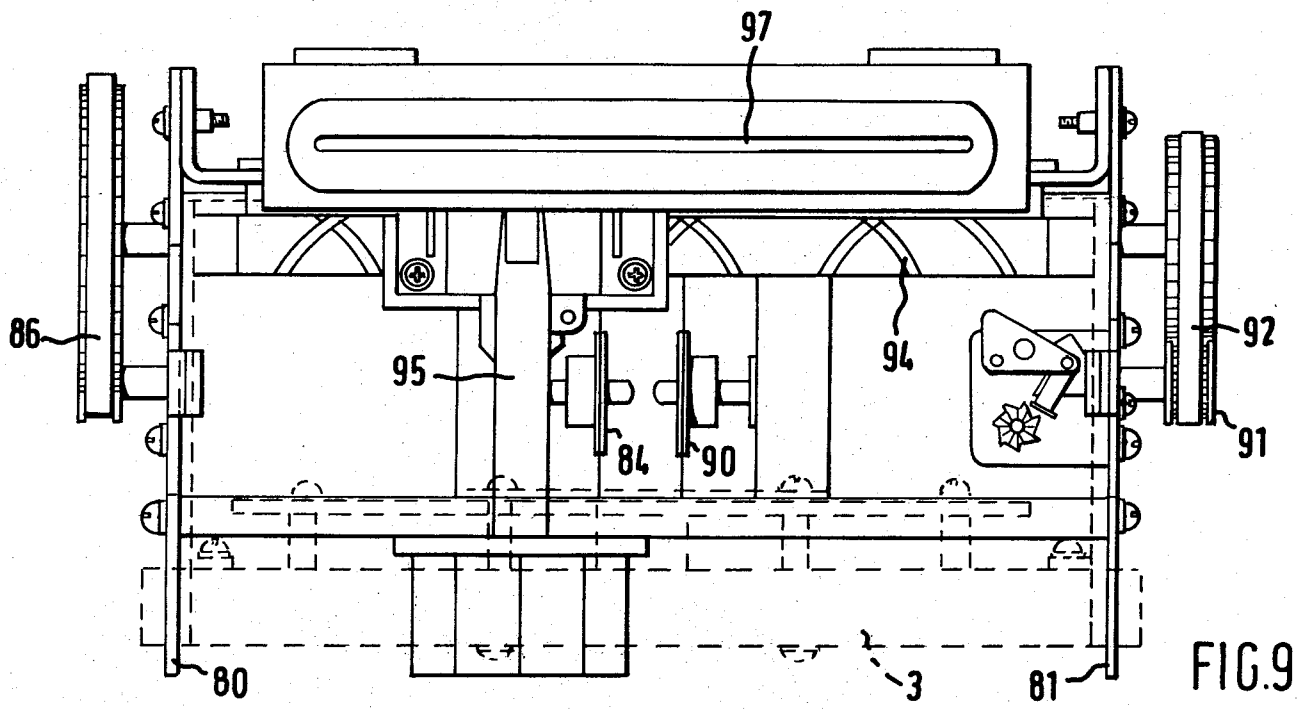
Figure 10:
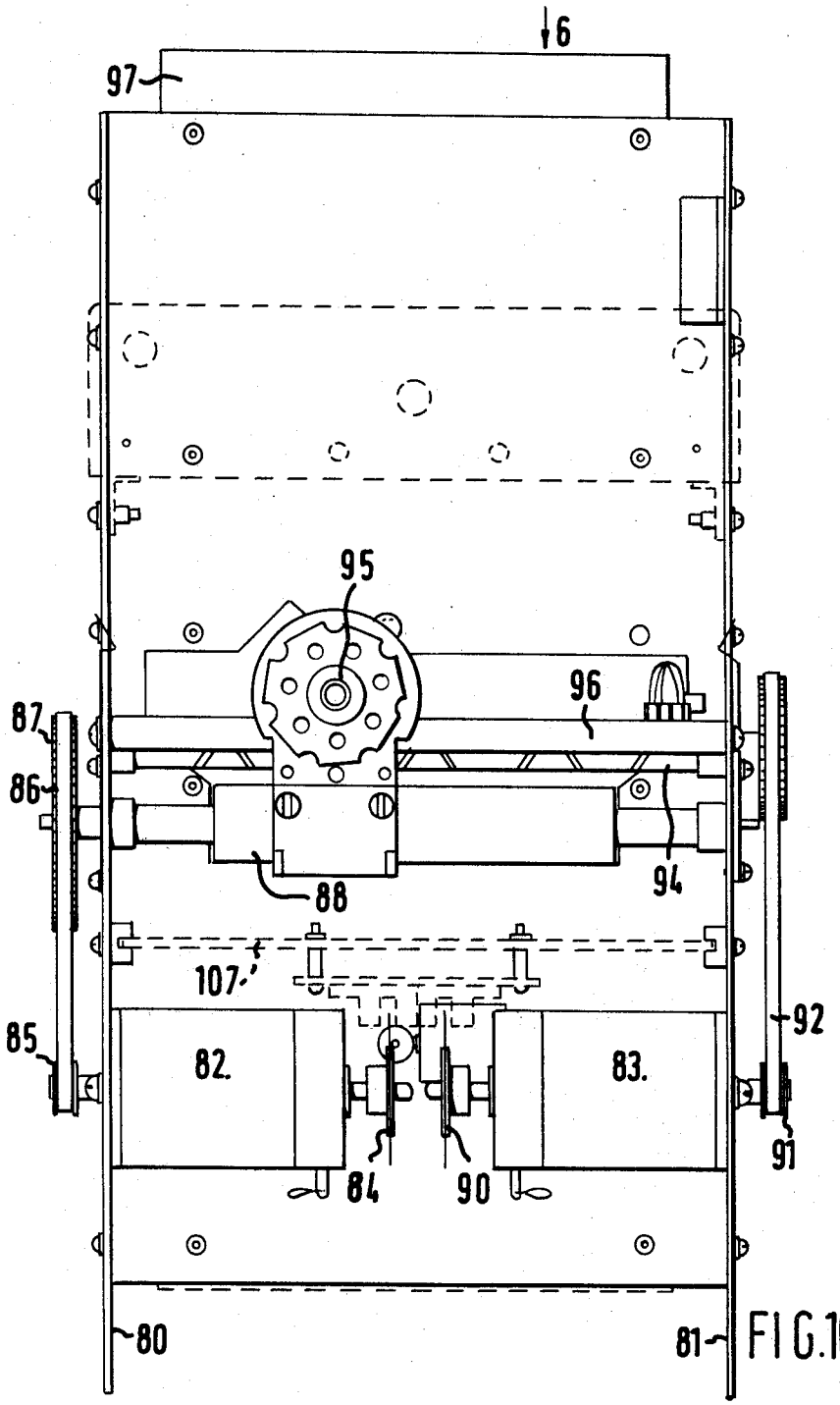

Referring now to FIGS. 8–10 the card reader/printer assembly includes a pair of side plates 80 and 81 that support a card drive motor 82 and a printer traverse motor 83 respectively. The motor 82 has a central shaft one end of which carries an encoder disc 84 of a pulse generator and the other end of which carries a toothed pulley 85 that is connected by cogged belt 86 to a larger drive pulley 87 connected to the shaft of a card drive roller 88. Similarly the printer traverse motor 83 has a shaft carrying an encoder disc 90 and pulley 91 and is connected by cogged belt 92 to drive pulley 93 of the print head drive cam 94. A dot matrix print head assembly 95 including a follower is driven by the cam 94 transversely of a card in the guide channel of the reader/printer and is stabilised by headguide stringer 96 on which it is free to slide. Cards may be fed into the reader/printer and is stabilized by headguide stringer 96 on tween card drive roller 88 and a pair of idler rollers 97, 98 (FIG. 8) with the magnetic track in line with a reading head 99 and the writing head 100 that are on the card sensor circuit board 51.

Referring now to FIG. 8 the underside of board 51 that faces the back of the card and carries the read/-write heads is also provided with a set of four sensors 101–104 each comprising an infra-red photosensitive device 106 like the device in the badge reader. The detectors 101, 103 and 104 face no I-R reflective surface and are normally off (current low) but detector 102 that is in line with reading heads 99, 100 faces an aluminium reflective surface and is normally on (current high) because light emitted from device 105 is reflected to sensor 106. In operation the entry of a card is perceived by sensor 101 which notes an increase in reflectivity and signals the microcomputer to power the card reader/-printer. If what is inserted into the reader/printer is a card bearing a correctly positioned magnetic stripe normally ON sensor 102 that is in the path of the stripe will go OFF because of the attenuated reflection at the IR-absorbent magnetic stripe but sensor 103 which is normally OFF but faces a plain area of the card will turn ON. The combination of the OFF signal from sensor 102 with the ON signal from sensor 103 establishes the presence of a correctly positioned card in the card reader and signals the microcomputer to power the card drive motor 82 to advance the card into the reader/printer. The motor 82 will not be powered by insertion of a plain piece of paper or by insertion of a card the wrong way round because plain areas of card or paper are I-R reflective and the output of sensor 102 remains high. Data is read by the reading head 99 from the magnetic stripe and is rapidly processed so that when the same area of card reaches write head 100 it can be rerecorded with the updated information. Sensor 104 that is normally OFF and faces a plain area of the card gives an ON signal by the increase in reflectivity and this signal is used to enable write head 100. Thus the write head may record on the magnetic card the machine number applicable, time schedule, identity of the card, number of the clock, daily values of the five accumulators and totals in the five accumulators applicable to that card, this updated data being calculated by the microcomputer faster than the card moves and being held in a buffer until the card has reached the correct position for the writing head 100.

Advance of the card into the reader/printer continues until the top or trailing edge passes sensor 102 which returns to its reflective state. Accordingly the microcomputer signals motor 82 to decelerate and the card should be stationary by the time its top edge reaches sensor 103. Then motor 82 is caused to reverse and the card is fed slowly back until sensor 102 just perceives the magnetic track, thereby accurately positioning the card along the reader/printer. Then the card is transported upwards the necessary distance defined by the number of pulses of encoder disc 84 until the appropriate position has been reached for the printer 95 to print legible characters on the card in the latest line of print recording the entry or exit transaction. Then printer motor 83 is energized to traverse the print head to the appropriate position and printing is carried out by dot matrix printing as well known in the art. It is an advantage of this arrangement that a single motor control circuit board 107 (FIG. 10) can be used to control both the card transport motor 82 and the printer traverse motor 83, the card never needing to be moved during printing and the printer never needing to be traversed while the card is being moved.

On completion of printing the motor 82 is again energised to complete the card ejection.

The Control system

Figure 11:
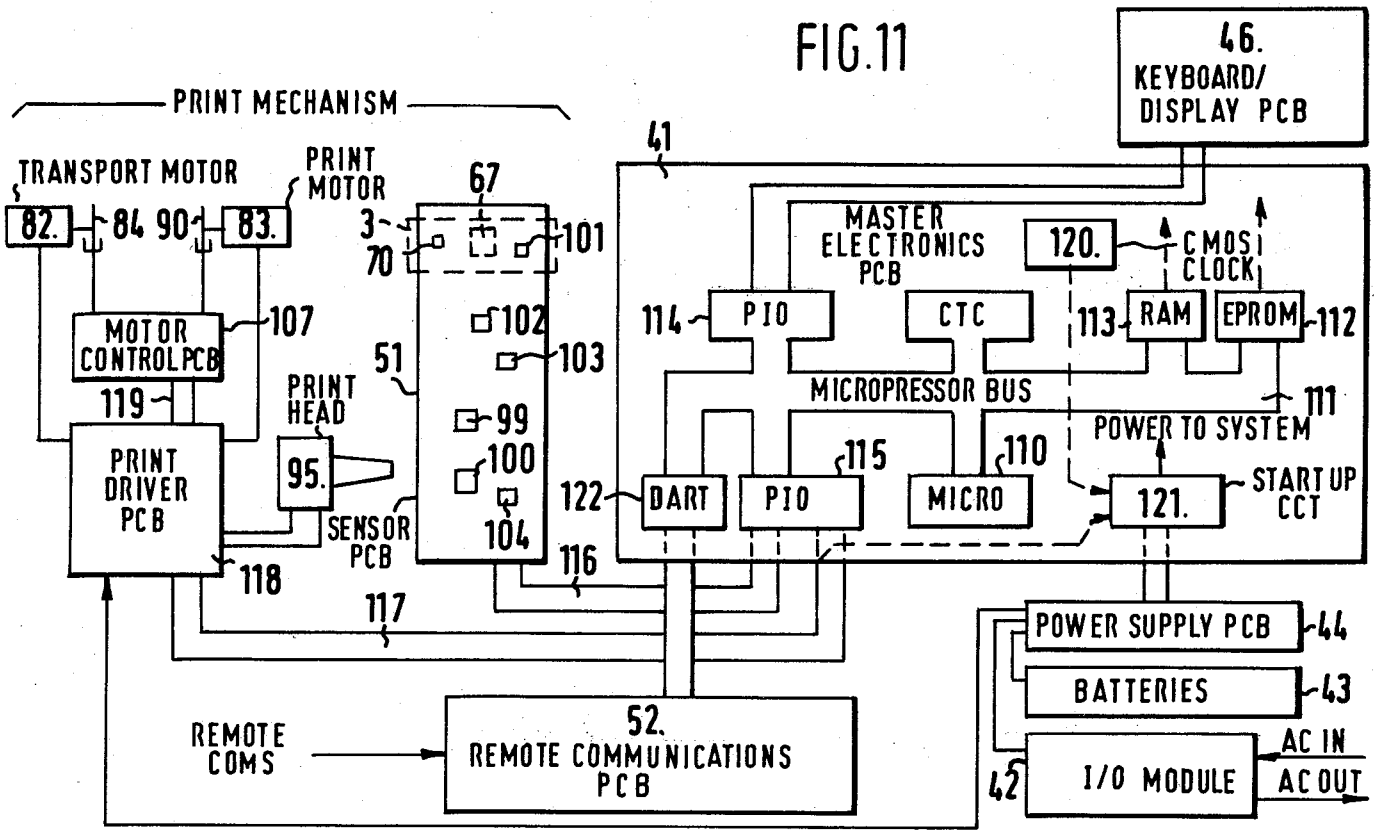
FIG. 11 is a block diagram of the keyboard, data processing, sensor printer and motor control systems.

The overall block circuit diagram is shown in FIG. 11. Microprocessor 110 (Zylog Z80) on master PCB 41 communicates through bus 111, with the permanent memory in a row of EPROMS 112 and with the random-access memory in a row of memory chips 113. Keyboard circuit board 46 communicates with bus 111 through peripheral input and output (PI0) device 114 and another PI0 device 115 communicates through bus 116 with sensor PCB 51 that relates to card and badge reading heads 67, 99 and sensors 70 and 101-104 and through bus 117 with a print driver printed circuit board 118 that controls the operation of the print head assembly 95 and is connected through bus 119 to the motor control board 107 that controls motors 82, and receives inputs from pulse generators associated with encoder discs 84, 90. A CMOS clock 120 on board 41 communicates with a start up circuit 121 that can supply power to sensor board 51 through bus 116 and controls the supply of power to the system as a whole. Thus in the rest state of the counter the CMOS clock operates continuously but the remainder of the counter is only powered intermittently (say once per minute) for so-called "housekeeping". A dual asynchronous receiver transmitter 122 communicates with remote communications board 52.

The row of random-access memory chips 113 may be of the CMOS kind and register all transient values such as user variable programming information, dates, line numbers and values in the five accumulators assigned to each card identity. The microcomputer chip 110 reads and writes signals from memories 112, 113 and from the associated devices through PIO ports 114, 115 via the bus 111 and can receive information from the magnetic stripes on the cards and badges and read and deliver information to the keyboard/program display printed circuit board 46. Through busses 116 and 117 it can control the card drive mechanism 82 and the operation of the print motor 83 and print head 95. Line power for the microcomputer can be by way of a 12 volt DC supply or an AC mains supply, the power supply PCB 44 being arranged to supply the required working voltages (ie. +5 volts, +24 volts etc.). The data memory in the row of RAM chips 103 is non-volatile, being maintained by a battery power supply 43 in the event of mains power failure. The computer system on the board 41 can be activated remotely by a serial data link 52. For this purpose a RS232C/20 mA serial communication port may be provided to allow remote interrogation or control either directly with a VDU or computer through a two wire link or indirectly through the Post Office telephone system using modems.

It will be appreciated that the personal information concerning each employee is held jointly in the magnetic stripe at the back of his card (if he is a card user) and in the non-volatile memory in chips 113 so that in the event of complete failure of the time recorder this information can be transferred to a similar recorder.

The cards may have any suitable dimensions for convenience in operation and to allow a suitable size of print that is compatible with the selected print head 95. Typically a card may be 100 mm (4 inches) by 178 mm (7 inches) by 0.25 mm (0.010 inches) thick.

It will be appreciated that various modifications may be made to the embodiments described above without departing from the invention, the scope of which is defined in the appended claims.

We claim:

1. A time/cost recorder for use in recording entry and exit transactions by badges bearing digitally encoded machine readable identity information and by cards bearing both digitally encoded machine readable identity information in the same recording medium and format and printed information in visible characters referring to the entry and exit transactions comprising:

read-only memory means for storing constant instructions for operation of the recorder;

random-access memory means including locations severally allocatable to the badges and cards for recording data relating to the entry and exit transactions of each badge and/or card according to the identity thereof;

a badge reader for reading the digitally encoded data on a badge inserted therein;

a combined card reader/printer including means defining a path for card insertion and discharge, card transport means including a drive motor for advancing an inserted card into the reader and ejecting it therefrom, a reader for reading the digitally encoded information on a card inserted therein and a printer assembly for printing visible characters on the inserted card;

a clock for supplying time signals; and a digital data processing and control system that receives the time signals and is arranged on receipt of a badge by the badge reader to update the memory locations referring to that badge in accordance with the indicated time and on receipt of a card by the reader/printer to cause the transport means to convey the card into the reader/printer so that the recorded information is read by the reader the memory locations referring to that card are updated in accordance with the indicated time, visible characters are printed on the card recording the transaction and the card processed is ejected from the reader printer whereby an identity may be allocated interchangeably to a card or to a badge either of which may be used to record an entry or exit transaction.

2. A recorder according to claim 1, wherein the badges and cards each carry a stripe of magnetic material for recording the digitally encoded information and the badge reader and the card reader/printer are each provided with a magnetic reading head for reading the encoded information on the stripe.

3. A recorder according to claim 2, wherein the digital data processing and control system includes a decoder that decodes both the information read from the badges by the badge reader and the information read from the cards by the card reader.

4. A recorder according to claim 2, wherein the badge reader is provided with a sensor in the form of an infra-red light emitter and a closely spaced infra-red photoconductor located in the track that the magnetic stripe on a badge is to take through the reader on the same side as the reading head and in advance thereof with respect to the intended badge travel direction, and an infra-red reflector is located opposite the sensor that when no card is present reflects radiation from the emitter to the photoconductor, the attenuated reflection from the magnetic stripe of a correctly inserted badge resulting in a reduced photoconductor current that is perceived by the data processing and control system as a card correctly present signal.

5. A recorder as claimed in claim 2 wherein the card reader/printer further comprises a magnetic writing head controlled by the digital data processing and control system to write onto the stripe of magnetic material on the card the identity data and during an entry or exit transaction the updated information recorded in said random-access memory locations allocated to said card.

6. A recorder as claimed in claim 5, wherein the data processing and control system is arranged to cause the card transport means to be driven forwardly by the motor to advance the card into the reader/printer and during the card advance to cause the reading head to read the encoded information on the stripe of magnetic material, subsequently to cause the writing head to write the updated information thereon, after which the card transport means is driven in reverse to convey the card to the position where the visible characters recording the transaction are to be printed, stopped during printer operation and driven again in reverse to eject the card from the reader/printer.

7. A recorder as claimed in claim 6, wherein a first sensor located adjacent the entrance of the reader/printer detects the insertion of a card therein and signals the data processing and control system to start the card transport means advancing the card into the reader/printer.

8. A recorder as claimed in claim 7, wherein second and third sensors each comprising an infra-red emitter and an infra-red photoconductor are provided, one of them being located in the track of the magnetic stripe on the card and having an opposed infra-red reflective surface, the other not, whereby conveyance of a correctly positioned card past the second and third sensors causes the signals from the normally high detector to fall by attenuation of the infra-red radiation at the stripe of magentic material and causes the signal from the normally low detector to go high by reflection from other regions of the card, simultaneous reception of both these signals by the data processing and control system indicating the presence of a card correctly positioned in the reader/printer after which the drive motor is enabled.

9. A recorder as claimed in claim 8, wherein a fourth sensor is located beyond said second and third sensors, passage of the card beyond the fourth sensor causing the writing head to be enabled.

10. A recorder as claimed in claim 9, wherein the data processing and control system is arranged to cause the card transport means to continue advance of the card into the reader/printer until the attenuated infra-red reflection signal of the stripe of magenetic material is no longer received, after which the card transport means is driven in reverse at a slow speed until the attenuated infra-red reflective signal is again received thereby defining the position of the top edge of the card and the card transport means is again driven in reverse to the position where visible characters are to be printed.

11. A recorder according to claim 1, wherein the random-access memory means further includes locations for storing user-variable instructions for operation of the recorder.

12. A recorder according to claim 11, wherein the user variable random access memory locations store instructions relating to shift patterns, hours of work within each shift pattern and rates of pay or cost accumulation within each shift pattern.

13. A recorder as claimed in claim 11, provided with a keyboard whereby user-variable instructions in the random-access memory means may be entered or varied, the data processing and control system being organised to accept a number of program variations each enabled by a selected one of a number of security badges when received by the badge reader.

14. A recorder according to claim 1, wherein the random-access memory locations include a first accumulator in which is recorded time worked in each day or other shift cycle, a second accumulator in which is recorded time worked in an accounting period defined by an integral number of days or other shift cycles terminating with the present day or cycle, and at least third and fourth accumulators in which time worked is stored at different rates according to user-variable rates of pay or cost accumulation.

15. A recorder according to claim 1, wherein the badge reader is further provided with a sensor for indicating the presence of a correctly inserted badge therein.

16. A recorder according to claim 1, wherein the printer assembly is arranged to print on one side of each card and the magnetic stripe is located on the other side of each card.

17. A recorder according to claim 1, wherein the badge reader and the combined card reader/printer are arranged so that the direction of travel of the badges through the badge reader is perpendicular to the direction in which cards are conveyed into and from the card reader.

18. A recorder according to claim 1, wherein the digital data processing and control system controls the printer so that it is enabled to print in/out times of employees on cards respectively allocated to the employees.

19. A recorder according to claim 18, wherein the digital data processing and control system controls the printer assembly to record lines across the card each of which includes a day's date, in/out times for the day, the total working time for the day and the accmulated working time for a period terminating with the day.

20. A recorder according to claim 19, in which the digital data processing and control system controls the printer assembly to record on each card total earnings by an employee at each of a plurality of rates over a specified period as well as to record the gross earnings by the employee for that period.

21. A recorder as claimed in claim 1, wherein the drive motor for the card transporter means has a shaft carrying an encoder disc, pulses sensed on rotation of the encoder disc being supplied to the data processing and control system that derives therefrom position and velocity information.

22. A recorder as claimed in claim 1, further comprising printer transport means including a drive motor that moves the printer transversely of the card to the positions where the visible characters are to be printed.

23. A recorder as claimed in claim 22, wherein the drive motor for the printer transport means also has a shaft carrying an encoder disc, pulses sensed on rotation of the encoder disc being supplied to the data processing and control system that derives therefrom position and velocity information.

24. A recorder as claimed in claim 23, wherein the drive motor for the card transport means and the drive motor for the printer transport means are selectively driven through a common control system.

25. A time/cost recorder for use in recording entry and exit transactions by badges bearing digitally encoded machine readable identity information and by cards bearing both digitally encoded machine readable identity information and printed information in visible characters referring to the entry and exit transactions, comprising a badge reader for reading the digitally encoded data on a badge inserted therein;

a combined card rader/printer including means defining a path for card insertion and discharge, card transport means including a drive motor for advancing an inserted card into the reader and ejecting it therefrom, a reader for reading the digitally encoded information on a card inserted therein, a printer assembly for printing visible characters on the inserted card and a writing head for writing onto the card encoded identity information; and a badge holder having the external dimensions of a card and having means for holding a badge in such position that when the badge holder is inserted into the reader/printer it traverses the writing head so that identity information is written in the appropriate position thereon.

26. A time/cost recorder according to claim 25, wherein said badges and cards each carry a stripe of magnetic material for recording the digitally encoded information, the badge reader and the card reader/- printer are each provided with a magnetic reading head for reading the encoded information on the stripe and the card reader/printer having a magnetic writing head aligned with the reading head in the direction of the path of a card through the reader/printer, the badge holder being dimensioned so that the stripe on a badge held therein traverse the reading and the writing head as the holder is advanced into and ejected from the reader/printer.

27. In combination with badges each adapted for recording thereon of digitally encoded machine readable identity information and cards adapted both for recording digitally encoded machine readable identity information and printed information in visible characters, a time/cost recorder for use in recording entry and exit transactions comprising a badge reader for reading the digitally encoded data on a badge inserted therein;

a combined card reader/printer including means defining a path for card insertion and discharge, a reader for reading the digitally encoded information on a card inserted therein and a printer assembly for printed visible characters on an inserted card recording the entry or exit transaction; and a digital data processing and control system fed with information from the badge reader and the card reader/printer and arranged so that an entry or exit transaction may be recorded using either a badge or a card.

* * * * *